US006878275B2

(12) United States Patent
Yamada

(10) Patent No.: US 6,878,275 B2
(45) Date of Patent: Apr. 12, 2005

(54) FUEL FILTER ARRANGEMENT INCLUDING FIBERS AND METHOD FOR MANUFACTURING THE SAME

(75) Inventor: Katsuhisa Yamada, Okazaki (JP)

(73) Assignee: Denso Corporation (JP)

( * ) Notice: Subject to any disclaimer, the term of this patent is extended or adjusted under 35 U.S.C. 154(b) by 99 days.

(21) Appl. No.: 10/265,677

(22) Filed: Oct. 8, 2002

(65) Prior Publication Data

US 2003/0071146 A1 Apr. 17, 2003

(30) Foreign Application Priority Data

Oct. 16, 2001 (JP) ..... 2001-318173
Aug. 9, 2002 (JP) ..... 2002-232671

(51) Int. Cl.[7] ..... F02M 37/22
(52) U.S. Cl. ..... 210/416.4; 210/491
(58) Field of Search ..... 210/416.4, 337, 210/338, 491, 492, 508, 416.1

(56) References Cited

U.S. PATENT DOCUMENTS 3,347,391 A * 10/1967 Steensen ..... 210/491
4,033,881 A * 7/1977 Pall ..... 210/491
4,983,193 A * 1/1991 Tani et al. ..... 55/487
5,716,522 A * 2/1998 Chilton et al. ..... 210/317

FOREIGN PATENT DOCUMENTS

JP A-3-175141 7/1991
JP 08024522 A * 1/1996 ..... B01D/29/07

* cited by examiner

*Primary Examiner*—Terry K. Cecil
(74) *Attorney, Agent, or Firm*—Nixon & Vanderhye PC

(57) ABSTRACT

A fuel filter arrangement includes a core member and a filter main body. The filter main body includes an inner filter and an outer filter, which is arranged at outside of the inner filter. A pore size of the outer filter is greater than a pore size of the inner filter. The inner filter is formed by immersing the core member in a high-density fiber solution and generating an inward flow of the high-density fiber solution through the core member. The outer filter is formed by immersing the core member, around which the inner filter is formed, in a low-density fiber solution and generating an inward flow of the low-density fiber solution through the core member and the inner filter.

13 Claims, 6 Drawing Sheets

FUEL FILTER ARRANGEMENT INCLUDING FIBERS AND METHOD FOR MANUFACTURING THE SAME

CROSS REFERENCE TO RELATED APPLICATION

This application is based on and incorporates herein by reference Japanese Patent Application No. 2001-318173 filed on Oct. 16, 2001 and Japanese Patent Application No. 2002-232671 filed on Aug. 9, 2002.

BACKGROUND OF THE INVENTION

1. Field of the Invention

The present invention relates to a method for manufacturing a fuel filter arrangement that removes undesirable foreign particles or objects from fuel. The present invention also relates to such a fuel filter arrangement.

2. Description of Related Art

When fuel, which contains undesirable foreign particles or objects, is supplied to a corresponding device, such as a fuel injector of an internal combustion engine, the foreign particles may prevent proper operation of the device. Specifically, for example, when the foreign particles contained in the fuel are caught in a valve of the fuel injector, the valve of the fuel injector cannot be closed completely, so that fuel is kept injected through the valve of the fuel injector. To address such a disadvantage, it is possible to arrange a fuel filter in a fuel passage connected to the fuel injector to remove the foreign particles from the fuel. Furthermore, in order to remove the foreign particles of different sizes, it has been proposed to arrange a filter of a relatively large pore size at an upstream side of the fuel passage and a filter of a relatively small pore size at a downstream side of the fuel passage. Furthermore, it has been proposed to form a fuel filter from a filter paper, which is folded.

However, placement of more than one fuel filter in the fuel passage causes an increase in a number of components and an increase in a number of seals between the fuel filters and the fuel passage, resulting in an increase in a number of assembling steps of the fuel filters. In order to address such a disadvantage, it has been proposed to provide a single fuel filter arrangement, which includes a filter of a relatively large pore size and a filter of a relatively small pore size. The filter of the relatively large pore size is arranged on a fuel inflow side of the fuel filter arrangement, and the filter of the relatively small pore size is arranged on a fuel outflow side of the fuel filter arrangement. With this fuel filter arrangement, it is possible to reduce a number of components and a number of seals.

However, in the previously proposed method where each fuel filter is formed by folding the filter paper made of the fibers, it is difficult to form a single fuel filter arrangement of a desired shape, which includes the filter of the relatively large pore size and the filter of the relatively small pore size joined together. Furthermore, when the fuel filter arrangement is formed of the filter papers, support plates need to be arranged on opposed axial ends of the fuel filter arrangement to support the fuel filter arrangement.

SUMMARY OF THE INVENTION

The present invention addresses the above disadvantages. Thus, it is an objective of the present invention to provide a method for manufacturing a fuel filter arrangement of a desired shape, which has a layer of a relatively large pore size and a layer of a relatively small pore size, in a relatively simple manner.

It is another objective of the present invention to provide a method for manufacturing a fuel filter arrangement, which has a support structure integrated therein.

It is a further objective of the present invention to provide a fuel filter arrangement of a desired shape, which has a layer of a relatively large pore size and a layer of a relatively small pore size.

To achieve the objectives of the present invention, there is provided a method for manufacturing a fuel filter arrangement. In the method, an inner filter, which has a first pore size, is formed around a core member, which has a plurality of through holes that penetrate through the core member. The inner filter is formed as follows. That is, the core member is immersed in a first fiber solution, which includes a plurality of fibers suspended in the first fiber solution at a first density. Then, an inward flow of the first fiber solution is generated through the core member from outside of the core member toward inside of the core member through the through holes of the core member. Next, an outer filter, which has a second pore size that is greater than the first pore size, is formed around the inner filter. The outer filter is formed as follows. That is, the core member, around which the inner filter is formed, is removed from the first fiber solution. Then, the core member is immersed in a second fiber solution, which includes a plurality of fibers suspended in the second fiber solution at a second density, which is lower than the first density. An inward flow of the second fiber solution is generated through the core member from the outside of the core member toward the inside of the core member through the inner filter.

To achieve the objectives of the present invention, there is also provided a fuel filter arrangement for removing foreign particles contained in fuel at a fuel intake side of a pump main body, which discharges the fuel toward a fuel injector. The fuel filter arrangement includes a fuel filter main body. The fuel filter main body is formed as an integral body and includes an inner filter and an outer filter. The inner filter includes fibers arranged at a first density. The outer filter is arranged at outside of the inner filter and includes fibers arranged at a second density, which is lower than the first density.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1A:
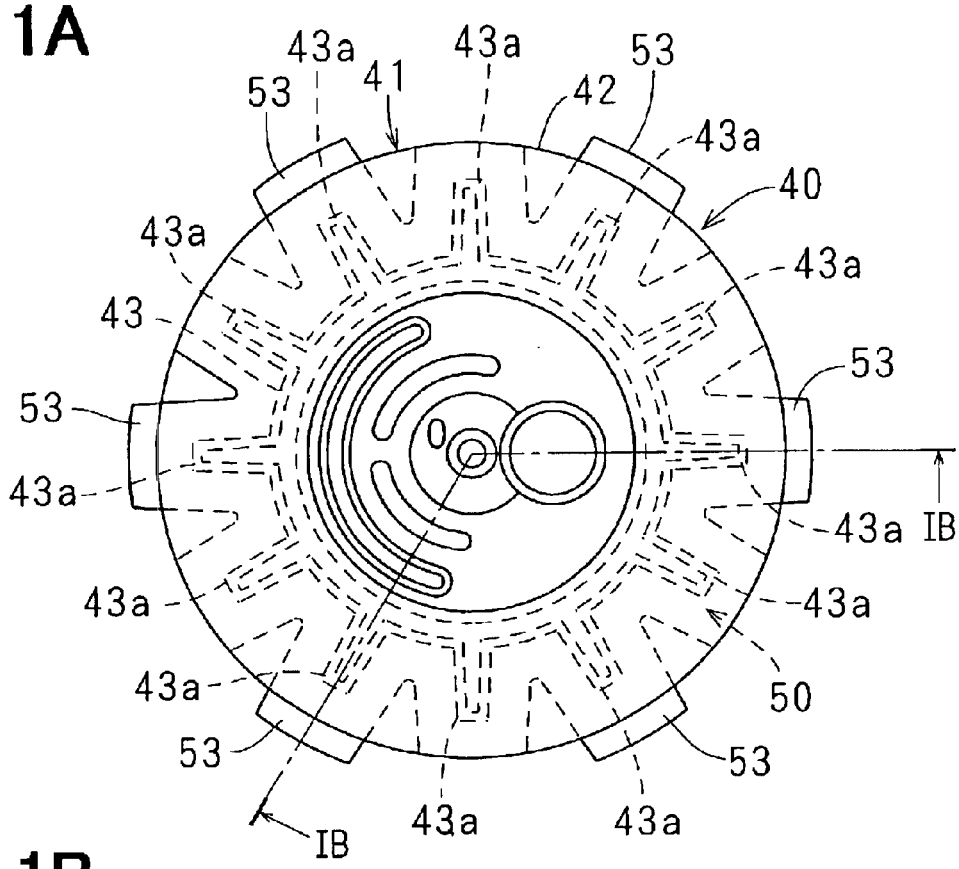
FIG. 1A is a plan view of a fuel filter arrangement according to a first embodiment of the present invention.

Various embodiments of the present invention will be described with reference to the accompanying drawings.

(First Embodiment)

A fuel supply apparatus 10 having a fuel filter arrangement 40 according to a first embodiment of the present invention will be described with reference to FIG. 3. The fuel supply apparatus 10 has a flange 11, which is engaged to a top wall of a fuel tank (not shown) that is molded as a single component from a resin material. Components of the fuel supply apparatus 10 other than the flange 11 are received in the fuel tank.

A fuel discharge pipe 12 and an electric connector 13 are made of the resin material and are integrally molded to the flange 11. However, it should be noted that the fuel discharge pipe 12 and the electric connector 13 can be provided as separate components and can be connected to the flange 11. The fuel discharge pipe 12 discharges fuel, which is discharged from a pump main body 30 received in a sub-tank 20, to outside of the fuel tank. A fuel discharge pipe 31 of the pump main body 30 and the fuel discharge pipe 12 of the flange 11 are connected to each other through a bellows pipe 21. A pressure regulator 14 is connected to the fuel discharge pipe 12 to adjust a pressure of the fuel, which is discharge from the fuel discharge pipe 12, equal to or less than a predetermined pressure.

The electric connector 13 is electrically connected to an electric connector 32 of the pump main body 30 through an electric line 22 to supply electric power to the pump main body 30.

One end of a metal pipe 15 is press fitted into a pipe support portion 11*a,* which is provided in the flange 11. Other end of the metal pipe 15 is loosely inserted into a pipe support portion 20*a* provided in the sub-tank 20. A spring 16 urges the flange 11 and the sub-tank 20 in opposite directions, respectively. With this arrangement, even when the resin fuel tank expands or contracts due to a change in an internal pressure of the fuel tank, which is induced by a change in temperature, or a change in an amount of fuel received in the fuel tank, a bottom portion of the sub-tank 20 is normally urged against a bottom inner wall of the fuel tank by urging force of the spring 16.

Figure 1B:
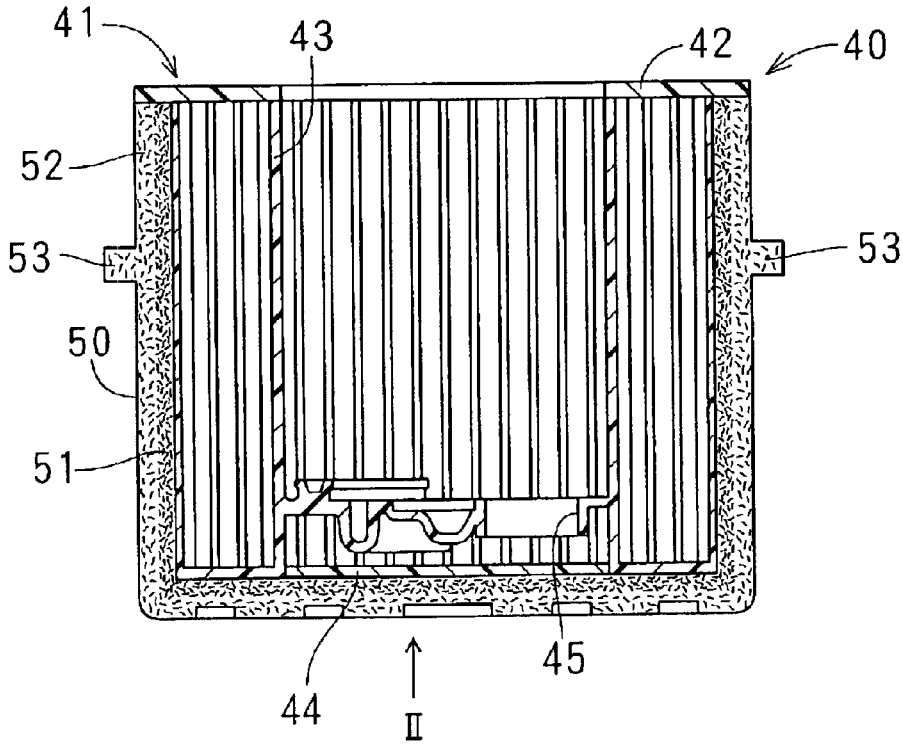
FIG. 1B is a cross sectional view along line IB—IB in FIG. 1A.

The fuel filter arrangement 40 includes a core member 41 and a filter main body 50. The fuel filter arrangement 40 surrounds the pump main body 30 and is arranged on a fuel intake side of the pump main body 30. As shown in FIG. 1, the core member 41 includes a flange 42, a tube portion 43 and a bottom portion 44. Thus, the core member 41 is formed into a tubular body (or cylindrical body), which includes a peripheral wall (or tube portion 43) and a bottom (bottom portion 44) connected to the peripheral wall. The flange 42, the tube portion 43 and the bottom portion 44 are molded from a resin material and are joined together, for example, by welding.

Figure 2:
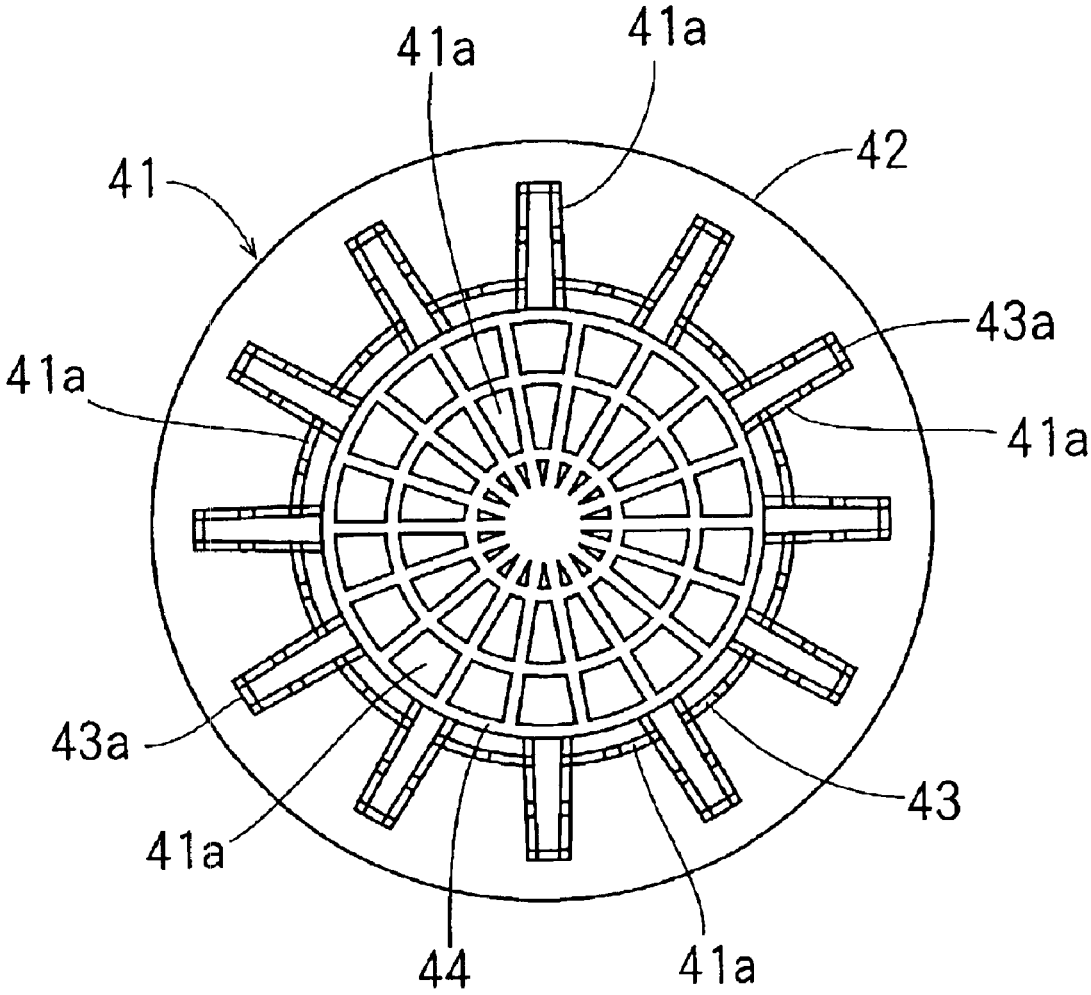
FIG. 2 is an end view seen in a direction of an arrow II in FIG. 1B, showing a core member of the fuel filter arrangement, from which both an inner filter and an outer filter are eliminated for the sake of clarity.

The flange 42 has a continuous annular shape. The tube portion 43 includes a plurality of radial projections 43*a,* which are arranged at equal intervals in a circumferential direction of the tube portion 43. Each radial projection 43*a* extends in an axial direction of the tube portion 43 and outwardly protrudes in a radial direction of the tube portion 43. The tube portion 43 includes a plurality of thin resin ribs, which are separated from each other by respective through holes 41*a*. Each resin rib of the tube portion 43 extends in the axial direction of the tube portion 43. Fuel can pass through each through hole 41*a*. A screen filter covers an outer peripheral portion of the tube portion 43. As shown in FIG. 2, the bottom portion 44 includes the through holes 41*a,* which are arranged in the radial direction of the tube body 43 and form a mesh structure.

The filter main body 50 is formed at outside of the tube portion 43 and also outside of the bottom portion 44. The filter main body 50 includes an inner filter 51 and an outer filter 52. The inner filter 51 is arranged closer to the tube portion 43 and the bottom portion 44 than the outer filter 52 on a fuel outflow side of the filter main body 50. The outer filter 52 is arranged at outside of the inner filter 51 on a fuel inflow side of the filter main body 50. The outer filter 52 includes six protrusions 53, which are arranged at equal intervals along an outer peripheral surface of the outer filter 52 and radially outwardly protrude from the outer peripheral surface of the outer filter 52. A composition of each protrusion 53 is the same as that of the outer filter 52. Each protrusion 53 engages an inner surface wall of the sub-tank 20 to reduce conduction of vibrations from the pump main body 30 to the sub-tank 20.

A density of the inner filter 51 is higher than that of the outer filter 52. The inner filter 51 is porous and has a pore size (pore size for protecting a fuel injector) of, for example, about 15–35 micrometers, preferably about 30 micrometers, which allows removal of foreign particles or objects that could be otherwise caught within a valve of the fuel injector. The outer filter 52 is also porous and has a pore size (pore size for protecting the pump main body) of, for example, 40–60 micrometers, which is larger than the pore size of the inner filter 51 and allows removal of foreign particles or objects that could be other wise introduced to a sliding portion of each rotatable component of the pump main body 30.

With respect to the compositions of the filters 51, 52, the inner filter 51 includes pulp (pulp fibers) and other fiber materials. Each fiber of the fiber materials of the inner filter 51 has an outer diameter equal to or less than a predetermined value. Furthermore, the outer filter 52 includes pulp (pulp fibers) and other fiber material. Each fiber of the fiber material of the outer filter 52 has an outer diameter greater than the predetermined value. More specifically, the inner filter 51 can include, for example, about 35% pulp (pulp fibers or group of pulp fibers), about 60% polyester fibers (a group of polyester fibers) and about 5% glass fibers (a group of glass fibers). Each pulp fiber of the inner filter 51 has an outer diameter greater than about 10 micrometers, preferably about 20–50 micrometers. Each polyester fiber of the inner filter 51 has an outer diameter equal to or less than about 10 micrometers, and each glass fiber of the inner filter 51 has an outer diameter equal to or less than about 1 micrometer. The outer filter 52 can include, for example, about 100% pulp (pulp fibers or a group of pulp fibers). The outer filter 52 can alternatively include about 60% pulp (pulp fibers or a group of pulp fibers) and about 40% polyester fibers (a group of polyester fibers). Here, each polyester fiber of the outer filter 52 has an outer diameter greater than about 10 micrometers. The outer filter 52 can further alternatively include about 60% pulp (pulp fibers or group of pulp fibers) and about 40% glass fibers (a group of glass fibers). Here, each glass fiber of the outer filter 52 has an outer diameter greater than about 1 micrometer. Furthermore, each pulp fiber of the outer filter 52 has an outer diameter greater than about 10 micrometers, preferably about 20–50 micrometers. The pore size of each of the inner filter (high-density layer) 51 and the outer filter (low-density layer) 52 can be easily adjusted by modifying an outer diameter of each fiber or a ratio between the pulp and the corresponding fiber material, i.e., by modifying the corresponding composition. Furthermore, through this modification, it is possible to satisfy required characteristics of the fuel filter arrangement.

Figure 4A:
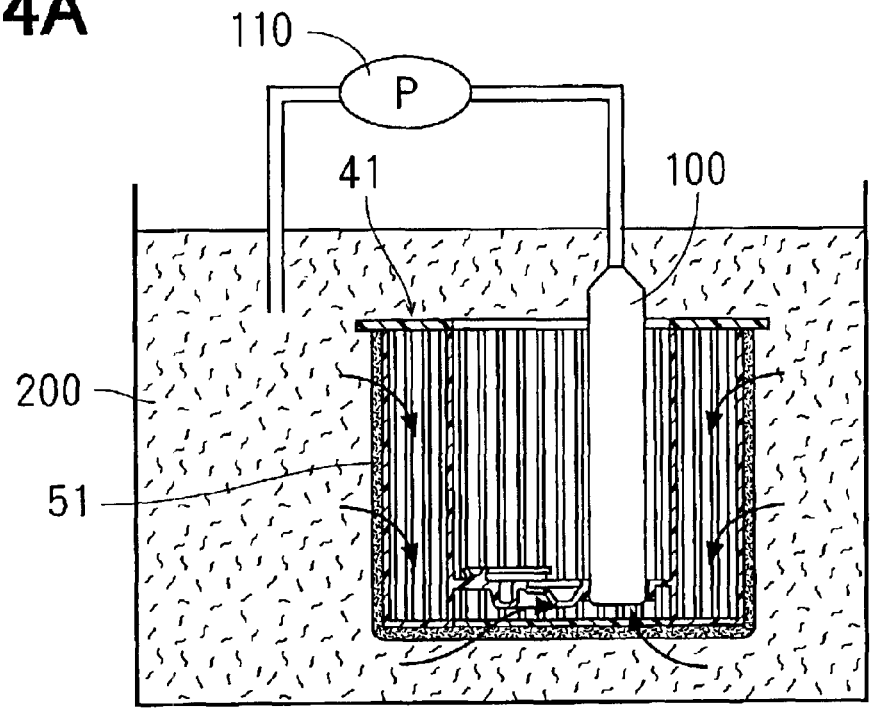
FIG. 4A is a schematic view showing part of a manufacturing method of the fuel filter arrangement according to the first embodiment.
Figure 4B:
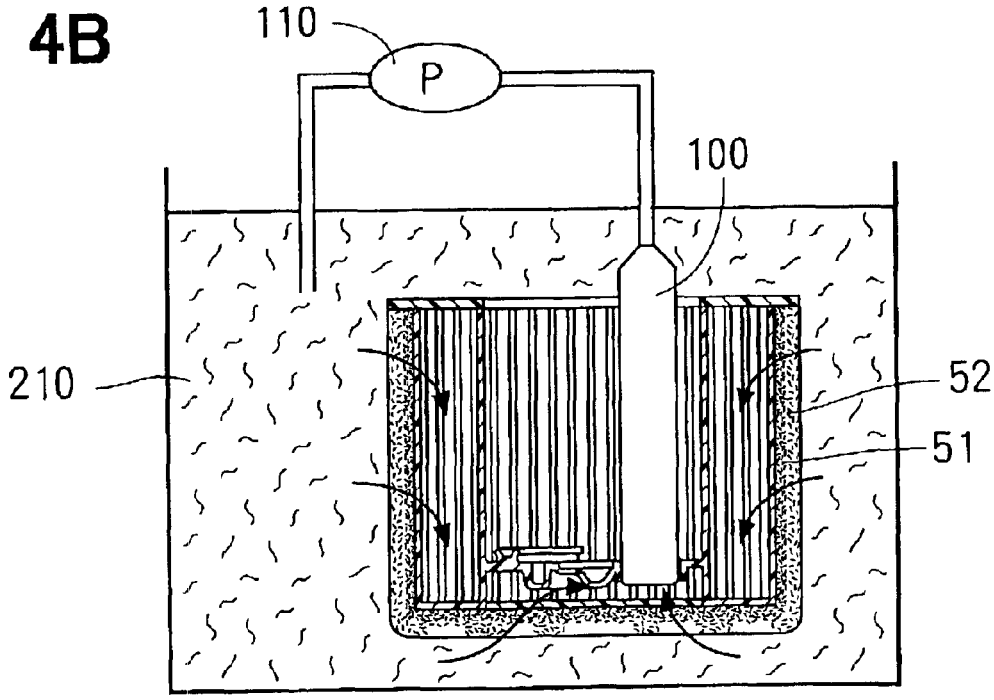
FIG. 4B is a schematic view showing another part of the manufacturing method of the fuel filter arrangement according to the first embodiment.

A method for manufacturing the fuel filter arrangement 40 will be described with reference to FIGS. 4A and 4B.

(1) A suction jig 100 is inserted into the core member 41 such that the suction jig 100 is located inside of an inner circumferential edge of the core member 41. The suction jig 100 is in a form of a cylindrical body that has opposed ends, which are both opened. One of the opposed ends of the suction jig 100 is connected to the suction pump 110 through a pipe line.

(2) The core member 41, in which the suction jig 100 is inserted, is immersed in a high-density aqueous fiber solution (first fiber solution) 200, in which the materials of the above composition for making the inner filter 51 are dissolved or suspended. The suction pump 110 is actuated for a predetermined time period, so that the suction jig 100 generates a negative pressure and suctions the high-density fiber solution 200 through the through holes 41*a* of the core member 41 at the inside of the core member 41, creating an inward flow of the high-density fiber solution 200. Thus, the fibers, which are dissolved in the high-density fiber solution 200, adhere to the outside of the core member 41 except the flange 42 to form the inner filter 51. The high-density fiber solution 200, which is suctioned by the suction jig 100, is returned to the high-density fiber solution 200 through the suction pump 110.

(3) The core member 41, around which the inner filter 51 is formed, is lifted from the high-density fiber solution 200 while the suction pump 110 is actuated. Then, the core member 41 is immersed in a low-density aqueous fiber solution (second fiber solution) 210, in which the materials of the above composition for making the outer filter 52 are dissolved or suspended. The fibers are suspended in the low-density fiber solution at a density, which is lower than that of the fibers suspended in the high-density fiber solution. When the suction jig 100 exerts the negative pressure and suctions the low-density fiber solution 210 through the inner filter 51 at the inside of the core member 41 to create the inward flow of the low-density fiber solution 210, the outer filter 52 is formed at the outside of the inner filter 51.

(4) After the core member 41, which has the outer filter 52 formed at the outside of the inner filter 51, is lifted from the low-density fiber solution 210, molding dies are fitted around the outer filter 52 to mold the protrusions 53.

(5) The core member 41, which has the protrusions 53 provided in the outer filter 52, is immersed in a phenolic resin solution while the suction pump 110 is actuated, so that the phenolic resin is soaked or impregnated into both the inner filter 51 and outer filter 52 (alternatively, the phenolic resin may be impregnated only into the outer filter 52 to solidify the outer filter 52).

(6) The core member 41, which has the inner filter 51 and the outer filter 52 soaked with the phenolic resin, is lifted from the phenolic resin solution and is solidified.

The fuel filter arrangement 40 is formed through the above steps (1)–(6). The core member 41 is left in the fuel filter arrangement 40 as a support member for supporting the filter main body 50. In the first embodiment, the protrusions 53 are formed by the molding dies after the outer filter 52 is formed. Alternatively, the core member 41 can have protrusions, around which fibers are adhered to form the protrusions 53 after suctioning of the high-density fiber solution 200 and the low-density fiber solution 210.

As described above, the corresponding aqueous solution 200, 210, in which the fibers are dissolved, is suctioned from the inside of the core member 41 to form each of the inner filter 51 and the outer filter 52. Alternatively, as shown in FIGS. 5A and 5B, each of the inner filter 51 and the outer filter 52 can be formed by pumping or pressurizing the corresponding aqueous solution 200, 210, in which the fibers are dissolved, from the outside of the core member 41 toward the inside of the core member 41.

Figure 5A:
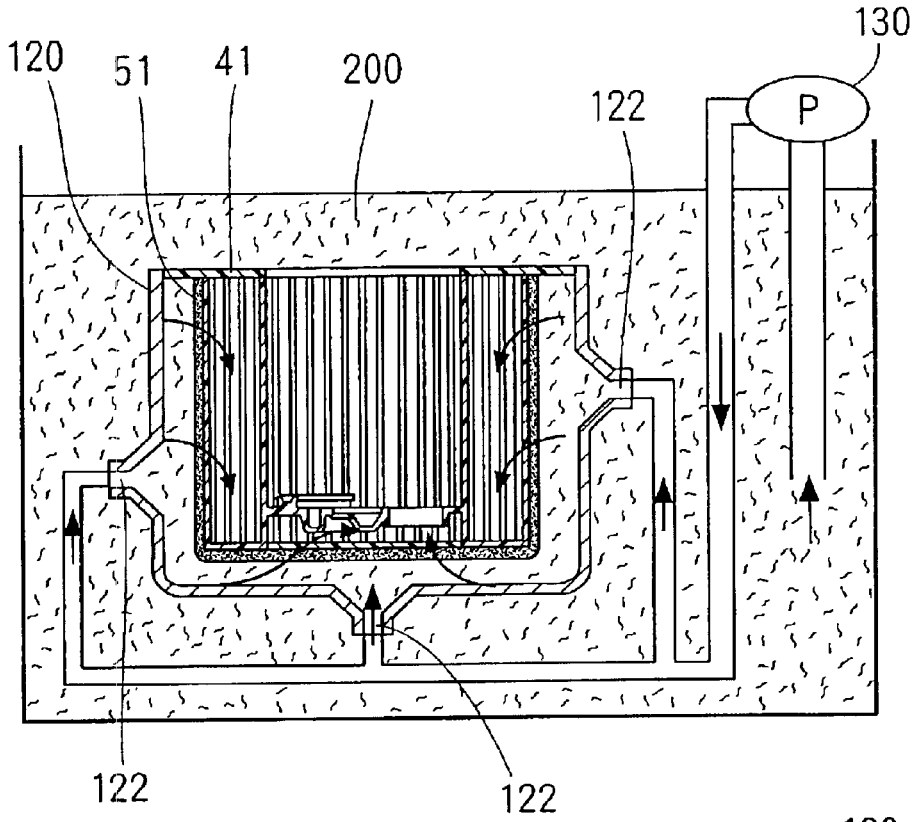
FIG. 5A is a schematic view showing part of a modification of the manufacturing method of the fuel filter arrangement according to the first embodiment.
Figure 5B:
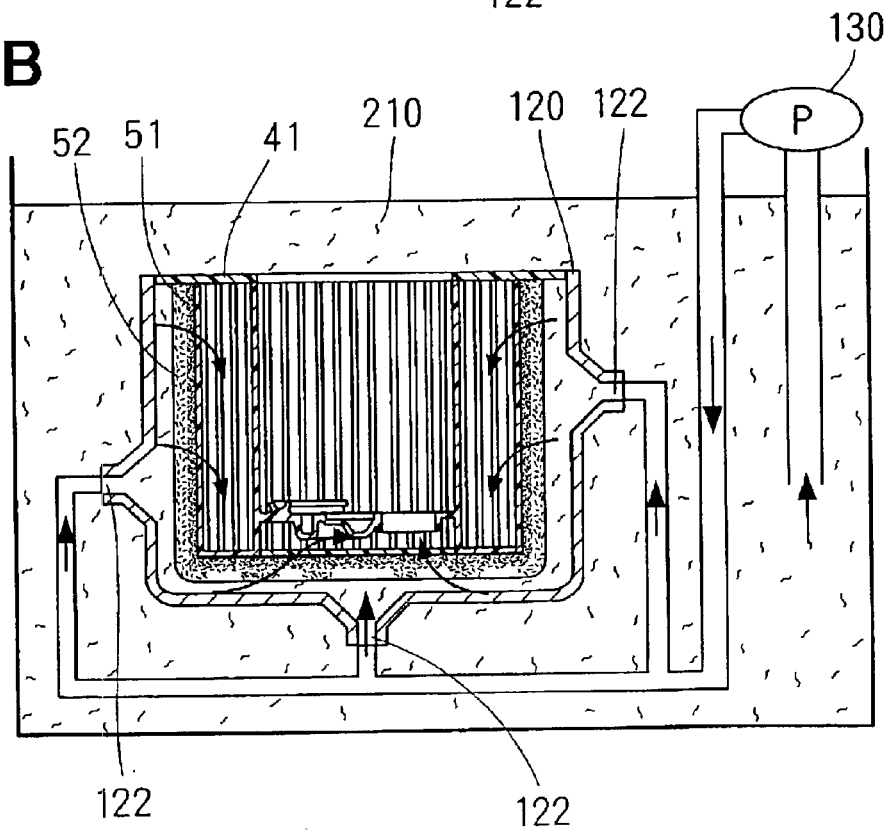
FIG. 5B is a schematic view showing another part of the modification of the manufacturing method of the fuel filter arrangement according to the first embodiment.

With reference to FIGS. 5A and 5B, as a modification of the above embodiment, in place of the suction jig 100, a pump jig 120 is provided. The pump jig 120 has inlet ports 122, which are formed in a peripheral wall and a bottom wall of the pump jig 120. The core member 41, which is surrounded by the pump jig 120, is sequentially immersed in the high-density fiber solution 200 and then in the low-density fiber solution 210 in this order, and the corresponding aqueous solution 200, 210 is pumped by a pressurizing pump 130 through a pipe line, which connects between the pressurizing pump 130 and the pump jig 120, so that the corresponding aqueous solution 200, 210 is pumped from the outside of the core member 41 toward the inside of the core member 41 through the through holes 41*a*. Thus, like in the above suctioning method, the high-density inner filter 51 is formed at the outside of the core member 41, and the low-density outer filter 52 is formed at the outside of the inner filter 51.

Next, operation of the fuel supply apparatus 10 will be described.

Figure 3:
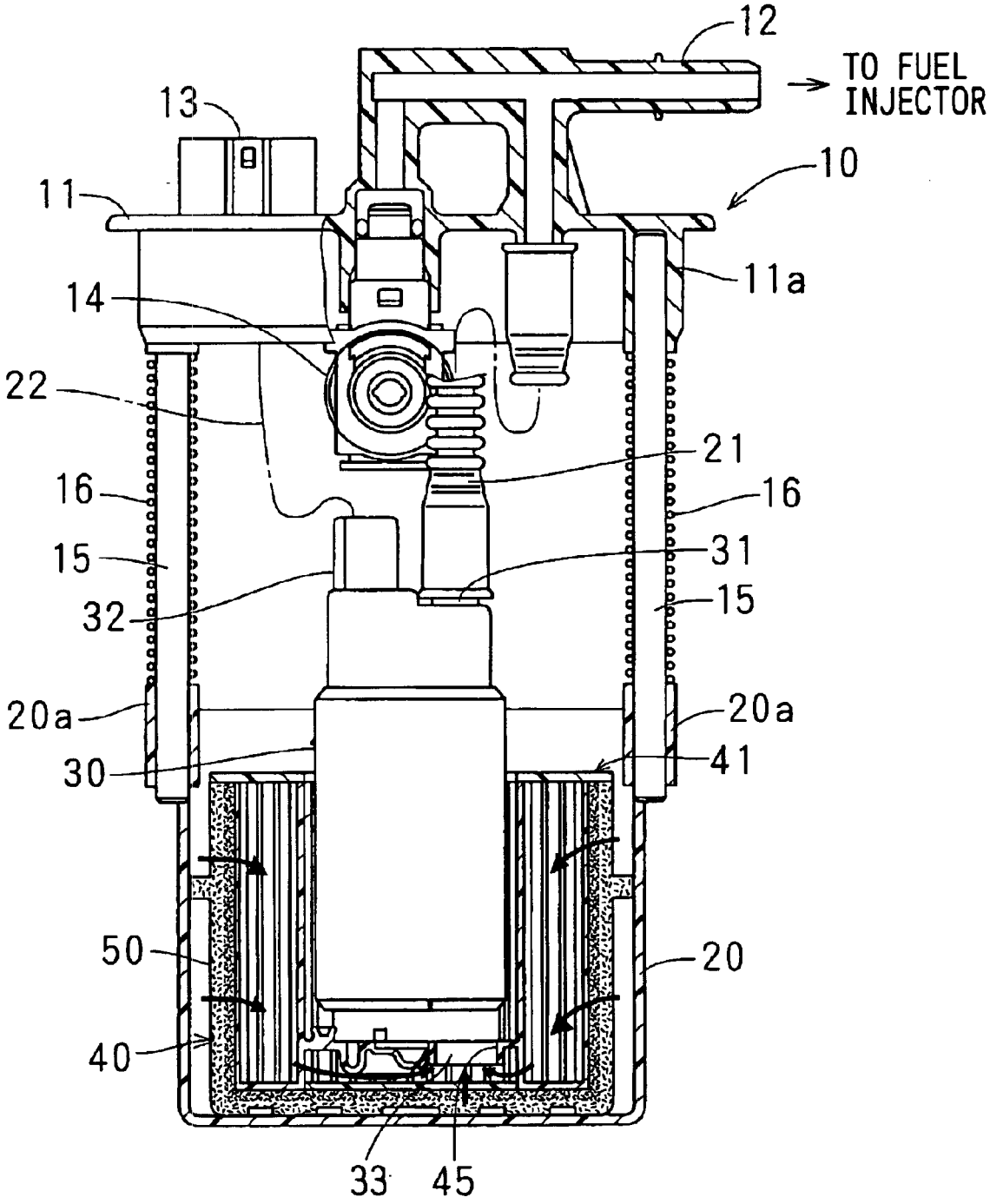
FIG. 3 is a longitudinal cross-sectional view of a fuel supply apparatus according to the first embodiment of the present invention.

With reference to FIG. 3, when an engine is started, and thus drive electric current is supplied from the electric connector 13 to the pump main body 30, fuel in the sub-tank 20 is suctioned by the pump main body 30 from a fuel intake opening 33 of the pump main body 30 through a fuel intake opening 45 of the core member 41 after the fuel passes through both the outer filter 52 and the inner filter 51. The pump main body 30 suctions the fuel received in the sub-tank 20 through the filter main body 50 to remove the undesirable foreign particles or objects from the fuel and discharges the fuel toward the engine side through the fuel discharge pipe 12.

A pressure of the fuel, which is discharged from the fuel discharge pipe 12, is adjusted to be equal to or less than a predetermined pressure by the pressure regulator 14. When excess fuel, which is returned from the pressure regulator 14 to the fuel tank, is discharged from a jet pump (not shown) to a fuel intake opening (not shown) of the sub-tank 20, a negative pressure thus generated causes suctioning of the fuel from the fuel tank into the sub-tank 20.

The outer filter 52 of the filter main body 50 removes relatively large foreign particles or objects to restrain intrusion of the relatively large foreign particles or objects into the sliding portion of each rotatable component of the pump main body 30. In this way, wearing of the sliding portion of each rotatable component of the pump main body 30 can be advantageously restrained, and thus malfunction of the pump main body 30 can be advantageously restrained. Furthermore, relatively small foreign particles or objects, which cannot be removed by the outer filter 52, are removed by the inner filter 51, and thus the capturing of the relatively small particles or objects within the valve of each fuel injector can be advantageously restrained. In this way, the valve of each fuel injector can be completely closed without being left open, so that malfunction of each injector can be advantageously restrained.

(Second Embodiment)

Figure 6:
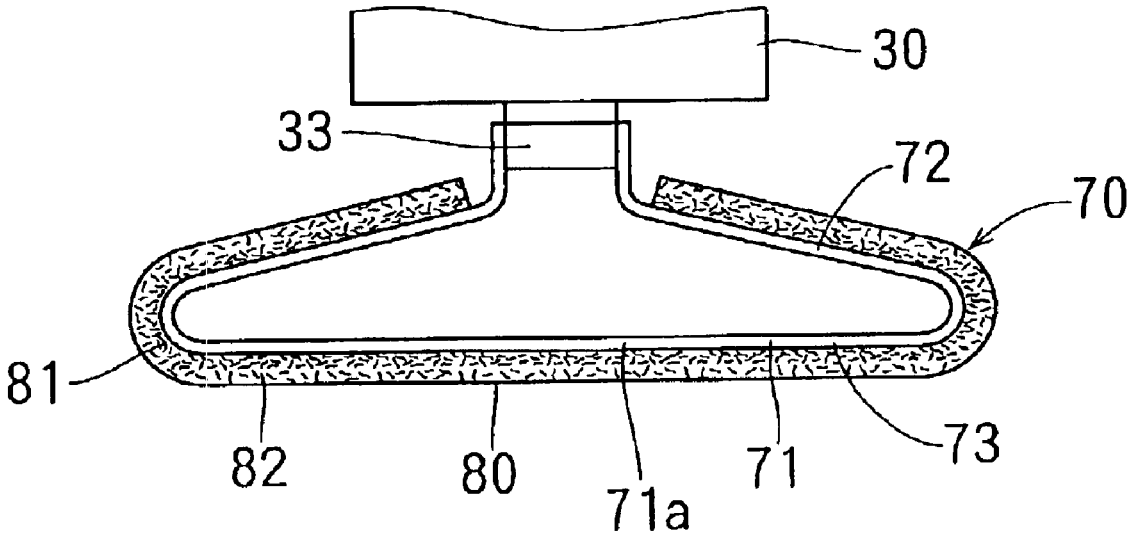
FIG. 6 is a longitudinal cross-sectional view of a fuel filter arrangement according to a second embodiment of the present invention.

A fuel filter arrangement 70 according to a second embodiment of the present invention will be described with reference to FIG. 6. In the second embodiment, components similar to those discussed in the first embodiment will be indicated by similar numerals.

The fuel filter arrangement 70 is connected to a fuel intake opening 33 of the pump main body 30. The fuel filter arrangement 70 includes a conical core member 71 and a filter main body 80, which is arranged outside of the core member 71. The filter main body 80 includes an inner filter 81 and an outer filter 82, which are arranged in this order at the outside of the core member 71. A composition of the inner filter 81 is substantially the same as that of the inner filter 51 of the first embodiment, and a composition of the outer filter 82 is substantially the same as that of the outer filter 52 of the first embodiment.

The core member 71 includes a conical portion 72, which has a conical shape, and a bottom portion 73, which has a circular disk shape. The core member 71 is molded from a resin material such that the conical portion 72 and the bottom portion 73 are molded as a single body. The core member 71 includes a plurality of through holes 71*a,* which are arranged to form a mesh structure. The method for manufacturing the inner and outer filters through suctioning or pumping of the corresponding aqueous solution and immersing of the inner and outer filters in the phenolic resin solution are similar to those discussed in the first embodiment.

In the above embodiments, the filter main body is formed as the integral body from the fibers, so that the filter main body can be formed into any desired shape by previously setting the shape of the core member or molding the outer filter with the corresponding molding dies upon completion of forming of the outer filter. By providing a recess or notch in the filter main body, a component of the fuel supply apparatus, which is arranged at the outside of the fuel filter arrangement, can be received in the recess or notch of the fuel filter arrangement. Thus, a size of the fuel supply apparatus can be reduced. Furthermore, the filter main body is molded as the integral body from the fibers, so that the filter main body can be easily supported. Furthermore, the filter main body can be relatively easily manufactured, so that manufacturing costs can be reduced.

The fuel filter arrangement is arranged only on the fuel intake side of the pump main body 30, so that the fuel of lower pressure, which has not been pressurized by the pump main body, passes through the filter main body. Thus, a robust support member, which securely supports the fuel filter arrangement, is not required, and also a seal arrangement, which seals fuel, is not required.

Furthermore, the fuel filter arrangement is arranged on the fuel intake side of the pump main body 30, the fuel filter arrangement always contact the fuel received in the fuel tank, so that electric charge of the fuel filter arrangement can be released to the fuel received in the fuel tank. Thus, grounding of the fuel filter arrangement is not required, allowing a reduction in the number of the manufacturing steps.

Furthermore, the core member, which is used during the suctioning and pumping of the corresponding aqueous solution that contains the fibers, is left in the filter main body and is used as the support member of the filter main body, so that there is no need to provide a dedicated support component for supporting the filter main body.

The filter main body includes the two layers, i.e., the high-density layer and the low-density layer, so that when fuel passes through the outer filter, which is made of the low-density layer, and the inner filter, which is made of the high-density layer, the relatively large foreign particles or objects can be removed by the outer filter, and the relatively small particles or objects can be removed by the inner filter. As a result, the performance of the fuel filter arrangement for removing the foreign particles or objects can be improved.

In the above embodiments, the fuel filter arrangement is arranged on the fuel intake side of the pump main body 30 in the fuel supply passage, which supplies the fuel to each fuel injector. This arrangement can be modified as follows. That is, the fuel filter arrangement can be arranged on the fuel discharge side of the pump main body 30. Furthermore, as long as the foreign particles or objects of different sizes are removed, the fuel filter arrangement of the present invention can be arranged in any fuel passage.

Additional advantages and modifications will readily occur to those skilled in the art. The invention in its broader terms is therefore, not limited to the specific details, representative apparatus, and illustrative examples shown and described.

What is claimed is:

1. A fuel filter arrangement for removing foreign particles contained in fuel at a fuel intake side of a pump main body, which discharges the fuel toward a fuel injector, the fuel filter arrangement comprising a fuel filter main body, which is formed as an integral body and includes an inner filter and an outer filter, wherein:

the inner filter and outer filter are contiguous so as to be seamlessly joined together;

the inner filter includes fibers arranged at a first density;

the fibers of the inner filter include pulp fibers;

the outer filter is arranged at outside of the inner filter and includes fibers arranged at a second density, which is lower than the first density; and the fibers of the outer filter include pulp fibers, wherein the outer filter includes a plurality of protrusions disposed at equal intervals along an outer peripheral surface of the outer filter and protruding radially outwardly from the outer peripheral surface of the outer filter so that when said fuel filter main body is disposed in a sub-tank structure of a fuel tank assembly, said protrusions engage an inner surface wall of the sub-tank to reduce conduction of vibrations from a pump disposed within the fuel filter arrangement to the sub-tank.

2. A fuel filter arrangement according to claim 1, wherein:

the inner filter has a first pore size; and the outer filter has a second pore size, which is greater than the first pore size.

3. A fuel filter arrangement according to claim 2, wherein:

the first pore size for protecting the fuel injector is about 15 to about 35 micrometers; and the second pore size for protecting the pump main body is about 40 to about 60 micrometers.

4. A fuel filter arrangement according to claim 1, wherein said inner filter includes about 35% pulp fibers, about 60% polyester fibers and about 5% glass fibers.

5. A fuel filter arrangement according to claim 4, wherein each pulp fiber of the inner filter has an outer diameter greater than about 10 micrometers, each polyester fiber of the inner filter has an outer diameter equal to or less than 10 micrometers, and each glass fiber of the inner filter has an outer diameter equal to or less than about 1 micrometer.

6. A fuel filter arrangement according to claim 5, wherein each pulp fiber of the inner filter has an outer diameter of between about 22 to about 50 micrometer.

7. A fuel filter arrangement according to claim 1, wherein the outer filter includes about 100% pulp fibers.

8. A fuel filter arrangement according to claim 1, wherein the outer filter includes about 60% pulp fibers and about 40% polyester fibers, wherein each polyester fiber the outer filter has a diameter greater than about 10 micrometers.

9. A fuel filter arrangement according to claim 1, wherein the outer filter includes about 60% pulp fibers and about 40% glass fibers, wherein each glass fiber of the outer filter has an outer diameter greater than about 1 micrometer.

10. A fuel filter arrangement according to claim 1, wherein each pulp fiber of the outer filter has an outer diameter greater than about 10 micrometers.

11. A fuel filter arrangement according to claim 10, wherein each pulp fiber of the outer filter has an outer diameter of between about 20 to about 50 micrometers.

12. A fuel filter arrangement according to claim 1, wherein the inner filter includes pulp fiber and a first other fiber material, the outer filter includes pulp fibers and a second other fiber, and wherein each fiber of said first other fiber material has an outer diameter equal to or less than a predetermined value and wherein each fiber of said second other fiber material has an outer diameter greater than said predetermined value.

13. A fuel filter arrangement for a fuel supply apparatus, wherein the fuel filter arrangement removes foreign particles contained in fuel at a fuel intake side of a pump main body of the fuel supply apparatus, which discharges the fuel toward a fuel injector, the fuel filter arrangement comprising a fuel filter main body, which is formed as an integral body and includes an inner filter and an outer filter, wherein:

the inner filter includes fibers arranged at a first density;

the outer filter is arranged at outside of the inner filter and includes fibers arranged at a second density, which is lower than the first density; and at least one outer peripheral part of the outer filter contacts an inner peripheral wall of a sub-tank of the fuel supply apparatus, which receives fuel, wherein the at least one outer peripheral part of the outer filter includes a plurality of protrusions, which protrude radially outwardly and contact the inner peripheral wall of the sub-tank of the fuel supply apparatus.

* * * * *